United States Patent [19]

Marshall

[11] Patent Number: 5,009,394

[45] Date of Patent: Apr. 23, 1991

[54] METAL FENCE POST EXTRACTOR

[76] Inventor: Rick A. Marshall, 14902 - 168th NE., Woodinville, Wash. 98072

[21] Appl. No.: 509,881

[22] Filed: Apr. 16, 1990

[51] Int. Cl.[5] ..... B66F 3/00

[52] U.S. Cl. ..... 254/30

[58] Field of Search ..... 254/133 R, 30–31, 254/132, 29 R

[56] References Cited

U.S. PATENT DOCUMENTS

| | | | |
|---|---|---|---|
| D. 298,794 | 4/1985 | Allen . | |
| 697,625 | 4/1901 | Hogenson . | |
| 1,916,463 | 7/1933 | Carrel | 254/132 |
| 1,999,174 | 4/1935 | Jackson | 254/30 |
| 2,807,494 | 2/1956 | Bulfer, Jr. . | |
| 3,762,687 | 10/1973 | De Rome et al. | 254/30 |
| 3,815,875 | 6/1974 | Koebel | 254/132 |
| 4,040,601 | 8/1977 | Boardman | 254/30 |
| 4,161,310 | 6/1978 | Parker . | |
| 4,738,433 | 3/1986 | Hoff . | |

*Primary Examiner*—Robert C. Watson

*Attorney, Agent, or Firm*—Larry A. Jackson

[57] ABSTRACT

A post extracting apparatus is disclosed in which a unitary bent plate of substantial thickness and strength having a "T" shaped aperture located in a plate portion adjacent the bend allows the plate to be slipped down over a T-shaped fence post to fit within about a foot or so of the buried base of the post. The bent plate implement is then rocked into a postgripping position and an upward force is applied to a protruding portion of the plate such as by means of a standard automobile jack. The T-shaped post is wedged by the plate device adjacent its aperture, thus making contact in as many as six (6), and at least four (4) locations on the post, depending on the size and uniformity of the fence posts, gripping the post so as to transfer the upward jacking force to the post causing its extraction.

20 Claims, 5 Drawing Sheets

METAL FENCE POST EXTRACTOR

BACKGROUND OF THE INVENTION

The present invention relates to devices for extracting metal fence posts of the type that are driven in the ground. More particularly, the invention relates to such extractors for metal fence posts, having a substantially T-shaped cross-section, a V-shaped anchor plate at the buried end, and uniformly spaced lugs along the flange of the T, for retaining fence wire. Each projection or lug defines a predetermined angle relative to a face of the flange.

DESCRIPTION OF THE PRIOR ART

A number of devices and apparatus have been created in the past for the purpose of removing a widely used type of fence post, a metal post having a T-shaped cross-section containing solid lugs on the face of the T flange, distributed evenly along the length thereof and having lug surfaces at a predetermined angle to the flange face for the purpose of supporting strands of wire, usually barbed wire or electrified wire supported by insulators. The lower end of the post is small enough in section to penetrate the earth while being driven into the ground to a depth of 18 to 24 inches or more and typically an anchor plate is provided somewhat above the endpoint to maintain alignment of the post during driving, and to prevent working the post back and forth which would cause enlargement of the hole and ultimately result in the post to be worked out by animals or the elements. It is by virtue of the anchor plate and the depth to which the post is driven that causes the extraction to be extremely difficult without bending or otherwise damaging the fence post.

Most previous removal devices have been designed with numerous parts, both moving and otherwise, making them cumbersome, complex, and more expensive to manufacture. The following patents are examples: U.S. Pat. No. 1,916,463 issued to Frank G. Carrel, Nov. 24, 1930; U.S. Pat. No. 2,807,494 issued to Joseph F. Bulfer, Jr., Feb. 13, 1956, which required a tractor with hoist; U.S. Pat. No. 4,161,310 issued to Merrill D. Parker, June 22, 1978; and U.S. Pat. No. 4,738,433 issued to Haral Hoff, Mar. 13, 1986. Two patents that are most related to the invention are: U.S. Pat. No. 3,762,687 issued to Eugene J. DeRome and Carl J. Hengst, Feb. 28, 1972; and U.S. Pat. No. 4,040,601 issued to Robert William Boardman, July 27, 1976. However, the means for extraction in these last named patents is by lifting a pipe that has been slipped over the post, upwardly to drive against the extractor, or by using a hoist to pull upward from above, which introduces a high probability of injury to the user and/or damage to the post should the drive pipe slip, or the lifting cable or chain fail or be pulled in a direction other than vertically.

SUMMARY OF THE INVENTION

Objects of the invention are to provide a metal fence post extractor of simple structure which is inexpensive to mass manufacture, used with facility, convenience and minimal effort (such as with the aid of a small hydraulic jack or the like), and functions efficiently, effectively, and reliably to remove a metal fence post from the ground without damage to the post, and with minimal exertion of energy to the user.

The apparatus has particular application in the removal of metal fence posts, or the like, which have been driven into the ground and are used on farms and ranches. Usual removal techniques cause the posts to be damaged or destroyed beyond the condition for reuse. It is important to the farmer to salvage the removed fence post intact, since they are used in great numbers and involve a substantial expense when lost.

The apparatus is to e used in conjunction with a hydraulic jack or the like, such as a standard automobile jack, applying a vertical force by jacking against the ground at a low point on the post, near the ground, minimizing the possibility of bending or damage to the post.

Furthermore, the present invention provides an inexpensive apparatus for removing fence posts. The apparatus quickly and easily slips over the post by means of an aperture generally matching that of the post cross-section and provides balanced forces on the post when a vertical and upward force is applied on the apparatus. With this apparatus, the forces in other than the vertical direction are substantially opposed and balanced. The apparatus avoids damage to the fence posts and so facilitates the removal of the fence posts as desired and as previously stated.

The apparatus utilizes a minimum number of parts, is inexpensively constructed and is adapted for use in connection with existing jacking devices.

In accordance with one aspect of the invention, a post extracting apparatus is provided which includes a unitary bent plate device, having an aperture located in a plate portion adjacent the bend which slips down over the T-shaped post to fit within about a foot or so of the buried base of the post. A preferred embodiment made in accordance with the principles of the present invention utilizes a metallic integral plate body of substantial thickness and strength. The aperture is an enlarged endwise projection of the T-shaped cross-section of the post being removed.

After placing the device over the post and sliding it to the desired elevation near the ground, the implement is rocked into its postgripping position. Then an upward force is applied such as by a standard automobile jack. The T-shaped post section is wedged by the plate device adjacent its aperture, thus making contact in as many as six (6), and at least four (4) locations on the post depending on the size and uniformity of the fence posts, gripping the post so as to transfer the upward jacking force to the post causing its extraction.

BRIEF DESCRIPTION OF THE DRAWINGS

In order that the invention may be best understood, it will now be described with reference to the accompanying drawings, wherein:

FIG. 3.1 is a plan view of FIG. 3

FIG. 4.1 is a plan view of the device in operative position as in FIG. 4.

FIG. 5.1 is a cross section through the T-shaped metal fence post of the largest T-section available.

FIG. 6.1 is a horizontal section cut through the smaller T-shaped post.

FIG. 6.2 is a cross-section through the embodiment and the shim part which is shown as an isometric in FIG. 6.3.

DETAILED DESCRIPTION OF THE INVENTION

Figure 1:
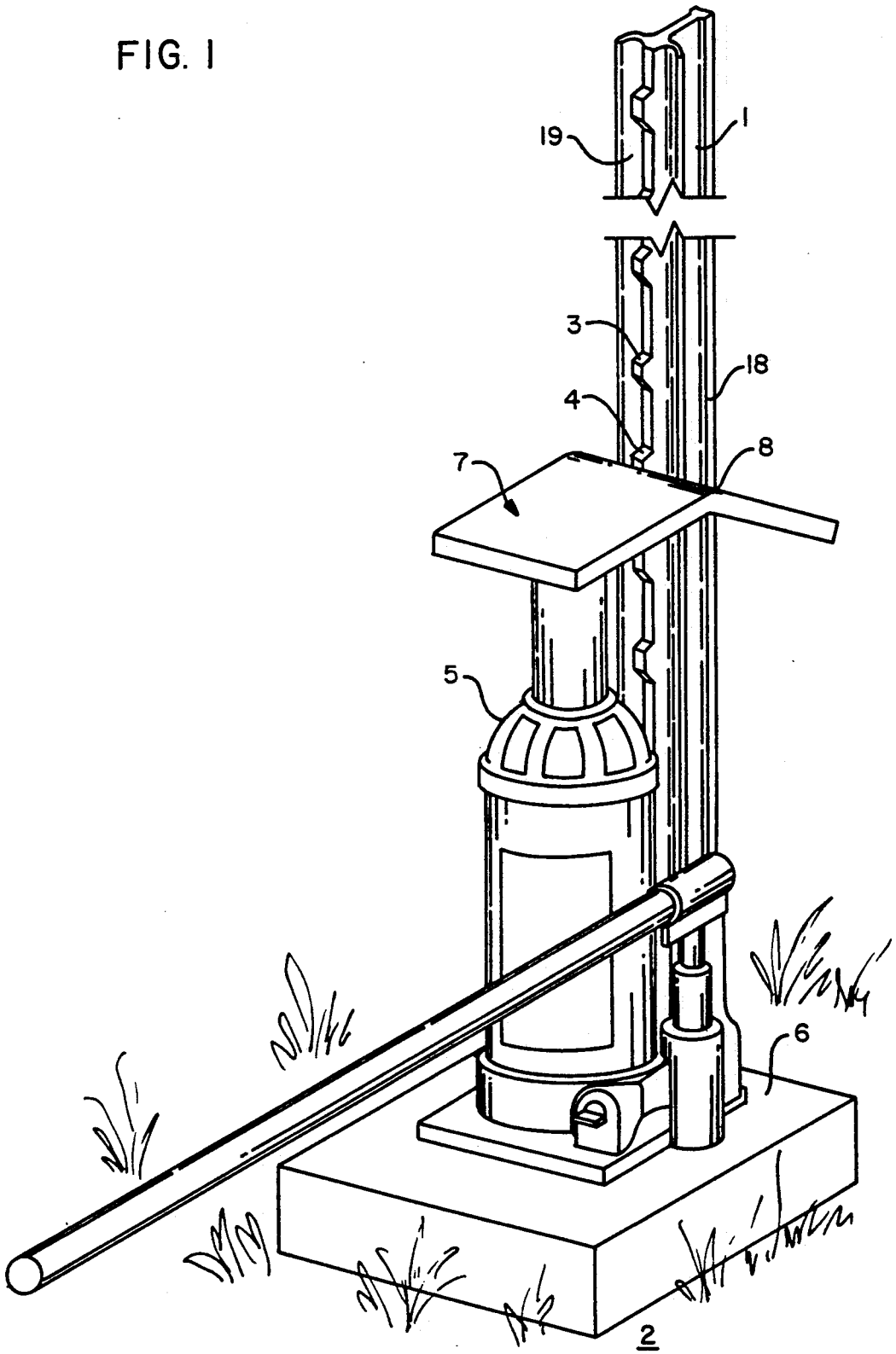
FIG. 1 is a perspective view of an embodiment of the unitary plate post extractor of the invention in use with the assistance of a standard hydraulic jack.

The metal fence post extractor device 7 of the invention functions to remove a standard, metal fence post 1 that has been previously driven into the ground 2 (FIG. 1). The fence post 1 is of the type having a "T" shaped crosssection, defining a stem portion 18 joined along one edge to the back of a flange portion 19, the opposite surface or face of which has a plurality of longitudinally spaced projections or lugs 3, 4, and so on (FIG. 1) projecting therefrom. These lugs 3,4 support the fence during normal use and by convention, usually have at least a lower bevel 20, sloping downwardly and inwardly at about 45 degrees to the face of the post's flange portion 19. Lugs 3, 4 thus provide attachment points on the post for supporting wire, barbed, or the like, that spans between the posts and which constitutes the actual fence.

Figure 2:
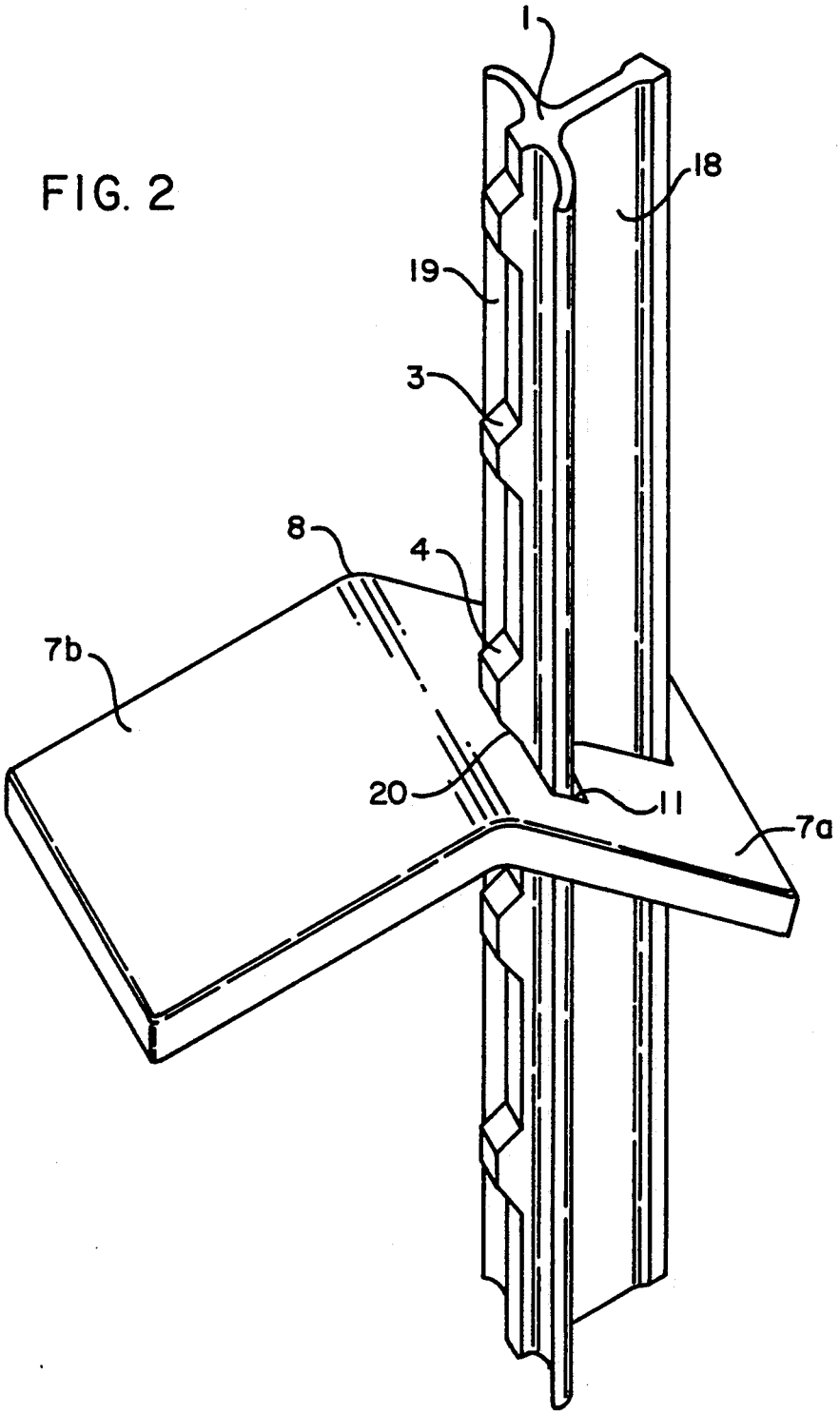
FIG. 2 is an isometric view in full scale of the embodiment in its assumed proper position without assist of a hydraulic jack.

As best shown in FIG. 2, fence post extractor of the invention is a unitary bent plate device 7, having a T-shaped aperture 11 sized so as to slip over post 1, clearing lugs 3, 4. The extractor device 7 has an obtuse bend 8 near the middle of the device so as to form a post gripping portion 7*a* in which aperture 11 is located, and leaving another portion 7*b* of device 7 projecting generally outwardly from the post 1 as shown in FIG. 1.

Although not essential, bent plate device 7 will typically have a greater length then width with bend 8 being crosswise of the longitudinal axis so that the projecting non-apertured portion 7*b* extends out from the post for receiving a jacking force that extracts the post from ground 2.

Figure 4:
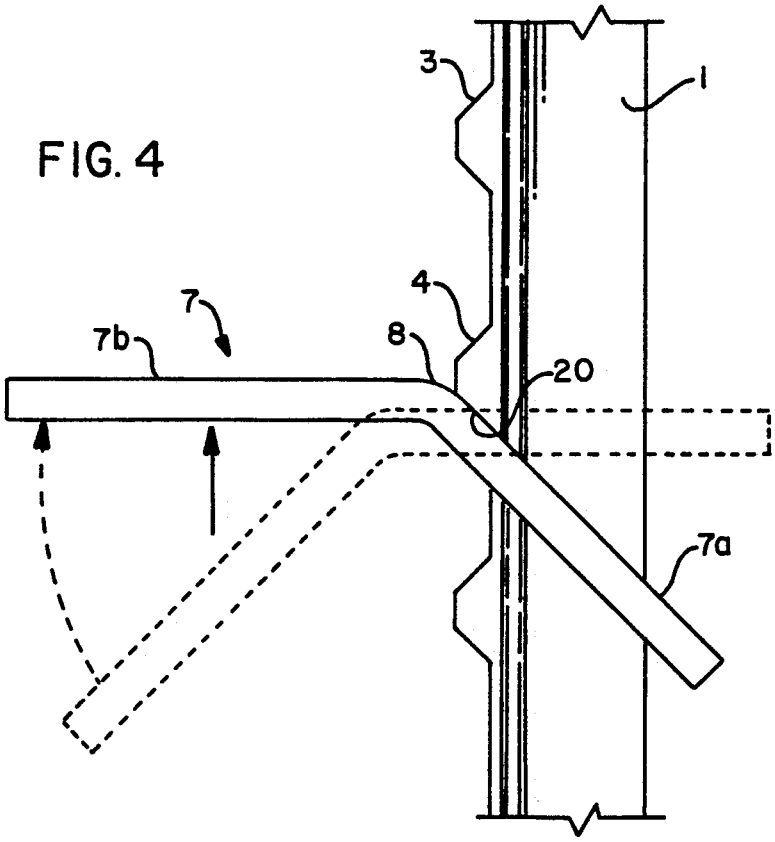
FIG. 4 is an elevation view of the embodiment having been rotated from its previously lowering position as in FIG. 4 (dashed lines) assuming the proper position within 8 to 10 inches off the ground, appropriately awaiting the pushing force of the hydraulic jack to remove the aforementioned metal fence post.

The post gripping apertured portion 7*a* of device 7 has the T-shaped aperture 11 formed therein, preferably by die stamping, but alternatively by machining or casting, with the stem of the T-shaped aperture generally aligned with the longitudinal axis of the device and the cross of the T aperture disposed parallel to and adjacent bend 8 but sufficiently spaced therefrom so that a substantial margin of the apertured portion 7*a* of the device is presented for engaging the lower bevel 20 of a lug 4 as shown in FIG. 4. Taking into account the strength and durability requirements of device 7, aperture 11 is preferably located inwardly from the lateral and end edges of the plate-like device 7 so as to provide sufficient strength to perform the gripping and forceful upward extraction of post 1. While the ratio of the aperture 11 dimensions to the overall lateral width and length of device 7 will vary depending upon the thickness and strength of the material used, a ratio of roughly one quarter of the T-shaped cross should be provided as a margin on opposite sides of the T as shown in FIG. 4.1 and likewise roughly the same ratio of margin, that is, one fourth of the stem length of the aperture is provided as a margin at the end of portion 7*a*. The margin of portion 7*a* between aperture 11 and bend 8 should substantially equal the sloping dimension of lug bevel 20. It is apparent that the corners of the plate-like device 7 can be removed for weight and cost saving if desired, so long as the basic ratio of aperture to width and length dimensions of device 7 are maintained consistent with the thickness and type of material used. Also the inside corners of aperture 11 may be rounded as shown or even cut away to present a more V shaped aperture for some applications so long as the aperture generally conforms to the post's cross section. For the preferred embodiment, a ⅜ or 5/16" stock steel plate of 4140 high carbon content steel is employed. The thicker material may be more difficult to effectively stamp with the cut-out of aperture 11 and therefore it may be preferable to use a thinner material but of higher strength steel such as A572 or A656.

The obtuse bend 8 is preferably the complement of the angle of bevel 20 and for a 45° lug bevel, the obtuse bend of device 7 is substantially equal to 135°. This angle, although not critical, should be within ± 10° of the complement of the lug bevel angle so as to present a substantially horizontal jacking portion 7*b* when the device 7 has been mounted and rocked to the gripping orientation as shown in FIG. 4.

Figure 3:
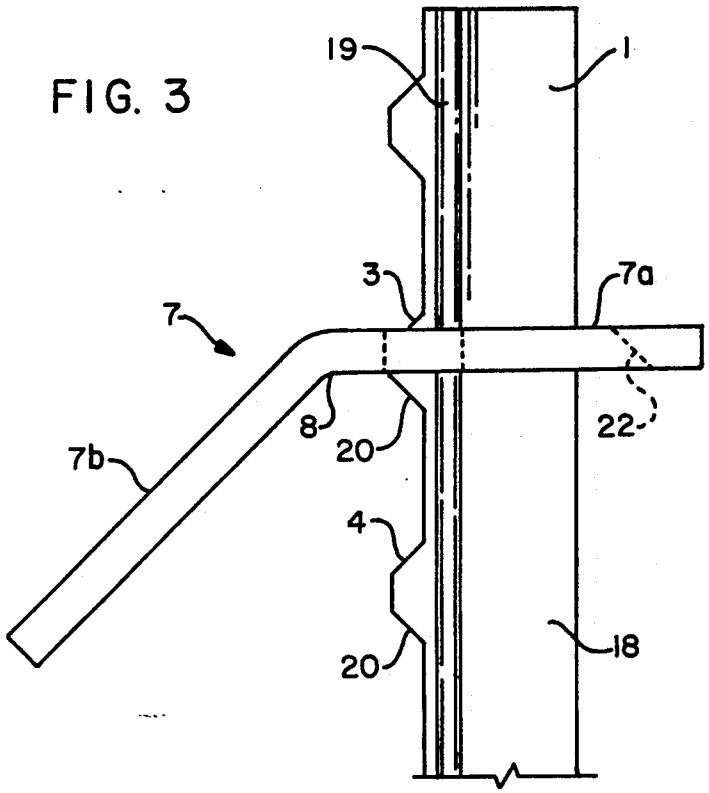
FIG. 3 is a full-scale elevation view of the device as it is lowered downwardly along the substantially T-shaped fence post section.
Figure 3:
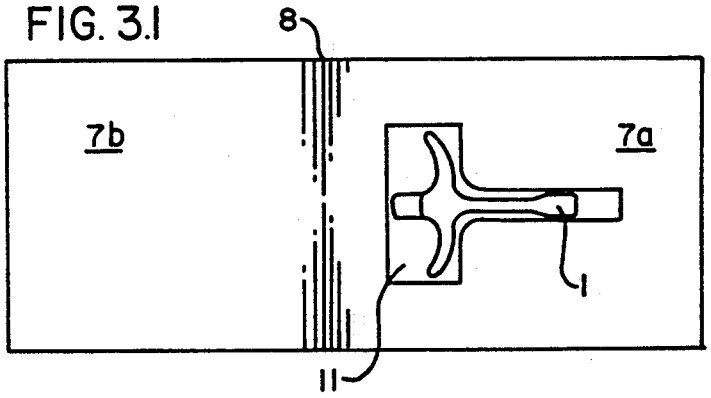
Figure 3:
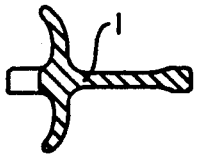
Figure 3:
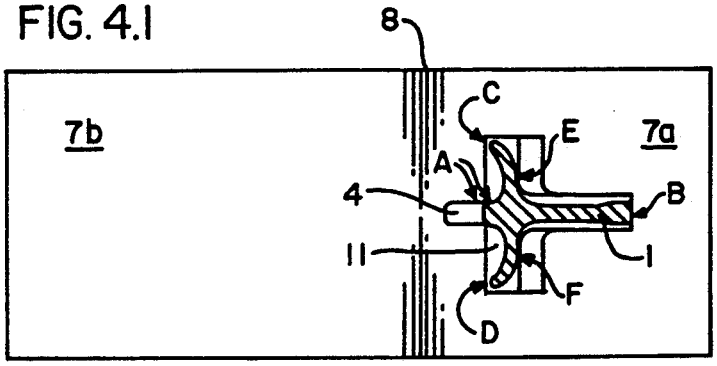
Figure 3:
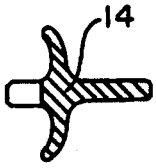

As best shown in FIG. 3.1, the dimensions of the T-shaped aperture are selected so that when the apertured portion of device 7 is disposed perpendicular to the length of post 1, the interior cross-section of the aperture is sufficient to clear lugs 3, 4 at the upper part of the T-shaped aperture. After device 7 is slid down over post 1 to a position near the base of the anchored post 1, such as approximately one foot above the ground level, then jack 5 and preferably a jacking block 6 are placed adjacent the face 19 having lugs 3, 4 and centered under the jacking portion 7*b* to apply an upward extraction force on device 7 and hence post 1. As a result, the device 7 attempts to rotate about the bend line from the position shown in FIGS. 3 and 3.1, causing the apertured portion 7*a* to slope down and away from bend 8, as shown in FIGS. 4 and 4.1 thus wedging the post in aperture 11.

More particularly, with the effective size of aperture 11 collapsed as indicated in FIG. 4.1 when viewed as a vertical projection, the length and width dimensions of the aperture foreshorten resulting in an orientation in which the marginal edges of aperture 11 contact and grip post 1 at as many as six points, A, B, C, D, E and F and at least four points, A, B, C and D or A, B, E & F. The upward jacking force on the jacking portion 7*b* produces a moment force that is resisted by the engagement of the stem portion of the aperture at B against the edge of stem 18 of the post and a counteracting force at A on the surface of lug bevel 20. The additional gripping action at points C, D, E and F further tighten the grip on the post allowing for efficient extraction as the jack drives the device 7 and post 1 upwardly.

Figure 5:
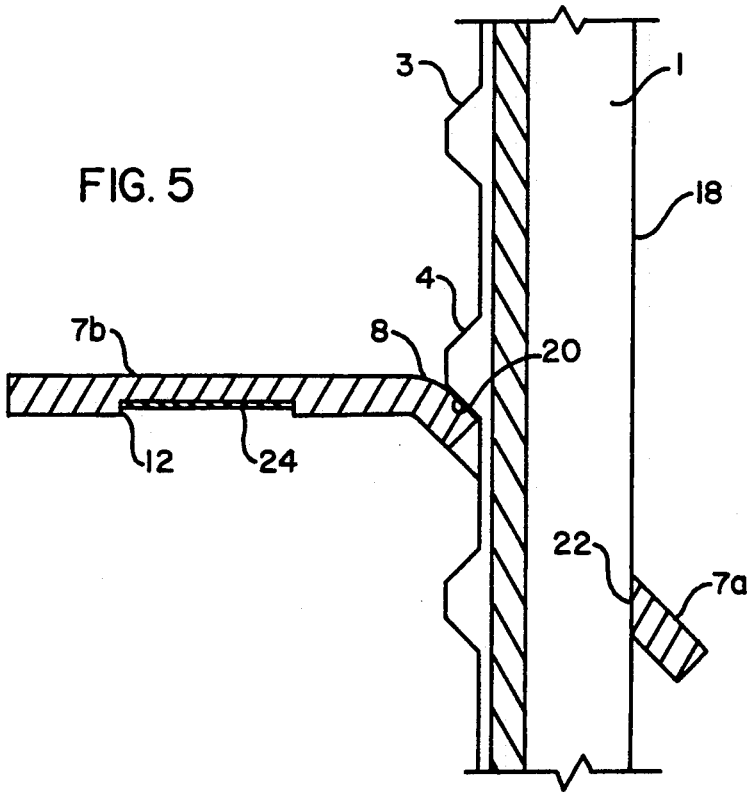
FIG. 5 illustrates a longitudinal section cut through the metal fence post and the embodiment indicating the T-shaped, elongated aperture allowing a vice-like grip leveraging against the T-shaped fence post section in its operating position.

Preferably, the interior face of aperture 11 at the T stem is provided with an interior bevel 22 so as to maximize friction on a flat surface at B, where the aperture 11 contacts and grips the edge of the post stem 18 as best shown in FIG. 5.

The jacking portion *7b* (FIG. 1) of device 7 preferably has a nonmetallic, nonslip load bearing pad 24 for centering a mechanical or hydraulic jacking implement 5. Here pad 24 is held slightly recessed in a right circular cylindrical depression 12 by suitable means such as bonding cement (FIG. 5). This allows the jacking implement 5 to properly seat without risk of slipping while under pressure, thus preventing possible injury or damage. The jacking implement (FIG. 1) is shown to be sitting on a block 6 (FIG. 1) of substantial size and thickness to provide a larger bearing surface for jacking against the earth.

Figure 6:
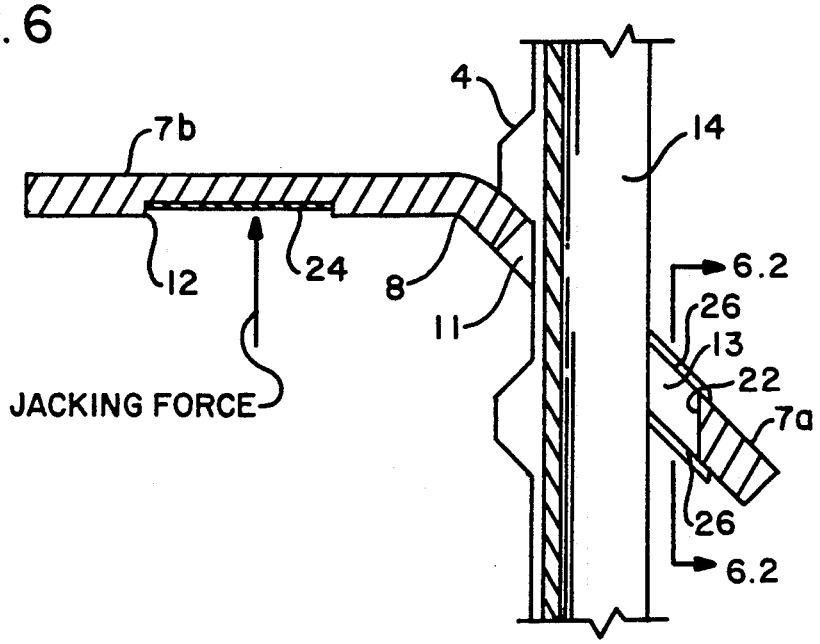
FIG. 6 is a horizontal section through the same aforementioned embodiment, but situated over a smaller T-shaped fence post, thus exposing a space between the post stem and the device into which an accessory part, such as a shim, is introduced to cause a proper fit.
Figure 6:
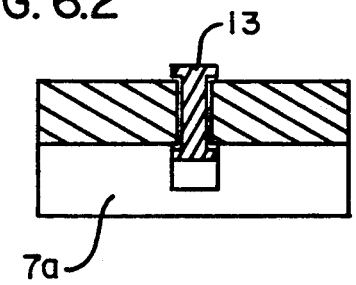
Figure 6:
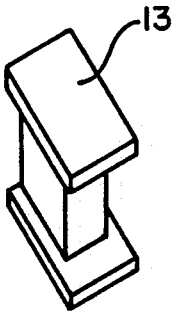

In some cases, metal fence posts of a thinner stock and smaller cross-section than the one previously described are used. For this purpose a shim 13 (FIG. 6, FIG. 6.2, FIG. 6.3) is placed between the stem terminus of the T aperture 11 and the stem edge of post 1 to take up the play and cause efficient force contact between the device 7 and the smaller section metal fence post. The smaller fence post is shown in section as 14 (FIG. 6.1) and has lugs 3, 4 as previously described. Shim 13 is of generally rectangular cross-section and preferably has upper and/or lower gibs 26, at sloping angles to the shim body so as to match the operating angle of the apertured position *7a* of device 7.

While the invention has been described by means of specific examples and specific embodiments, I do not wish to be limited thereto, for obvious modifications will occur to those skilled in the art without departing from the spirit and scope of the invention.

I claim:

1. An extractor device for dislodging from the ground metal fence posts of the type having a substantially T-shaped cross section and longitudinally spaced lugs, comprising:

a unitary metal plate having a length greater than width so as to define a longitudinal axis and being bent at an obtuse angle about a lateral bend line generally mid-length so as to divide the plate into a post gripping portion and a jacking portion;

a T-shaped aperture is formed in said post gripping portion substantially normal to the plane of the plate with the stem of the T aperture generally aligned with the longitudinal axis of the plate and terminating adjacent one longitudinal end of said plate, and the cross of the T aperture disposed crosswise of the plate adjacent said jacking portion and proximate said bend line so as to present an edge of said cross engageable with a post lug, said plate portions including said T-shaped aperture being sized so that in one orientation of the plate relative to the post, said T-shaped aperture slips along the length of the post, clearing post lugs, and in another orientation the edges of the T-shaped aperture and adjacent margins o the plate engage the post and one lug to grip the post and to exert a jacking force applied between ground and the jacking portion of the plate on the lug side of the post to extract the post.

2. The extractor device of claim 1 in which said aperture has a beveled interior edge at the extent of the stem portion, said beveled interior edge of said aperture being aligned with the stem edge of the T-shaped post when the plate is in its gripping orientation relative to the post.

3. The extractor device of claim 1 in which said jacking portion of said plate has a jack engaging structure provided on a surface of said plate portion on the interior angle side of the bend in said plate.

4. The extractor device of claim 1 further comprising a removable shim shaped and sized so as to fit in a space adjacent the stem portion of said aperture to contact and grip the stem portion of the T-shaped post when said plate is in its gripping orientation.

5. The extractor device of claim 4, wherein said shim has a polygon shape in which a first pair of opposed parallel surfaces contact opposing interior surfaces of the end of the aperture stem and the edge of the stem of the post.

6. The extractor device of claim 4, wherein said shim has flanges on the faces opposite said first mentioned parallel surfaces to retain said insert in position when the device is in the gripping orientation.

7. The extractor device of claim 1, wherein the interior obtuse angle between the jacking portion and apertured portion of the plate is between 125° and 155°.

8. The extractor device of claim 7, wherein the interior obtuse angle between the jacking portion and apertured portion of the bent plate is substantially 135° so that when the plate is moved to its gripping orientation relative to a post, the jacking portion of the plate is substantially perpendicular to the length of the post and parallel to ground.

9. A metal fence post extractor comprising:

a plate bent at an obtuse angle and having an apertured portion and a jacking portion on opposite sides of the bend in which the apertured portion has an aperture of generally the cross sectional shape of a post so that in one orientation of the plate the aperture slips over a T-shaped post and lugs thereon and in another orientation engages the post and a lug thereon to extract the post when a jacking force is applied between ground and the jacking portion of the plate on the lug side of the post.

10. The extractor device of claim 9 in which said aperture has a beveled interior surface at one extent of said aperture, said beveled interior surface of said aperture being aligned with the stem edge of the T-shaped post when the plate is in its gripping orientation relative to the post.

11. The extractor device of claim 9 in which said jacking portion of said plate has a jack engaging structure provided on a surface of said plate portion on the interior angle side of the bend in said plate.

12. The extractor device of claim 9 further comprising a removable shim shaped and sized so as to fit in a space adjacent the beveled interior surface said aperture to contact and grip the stem portion of the T-shaped post when said plate is in its gripping orientation.

13. The extractor device of claim 12, wherein said shim has a polygon shape in which a first pair of opposed parallel surfaces contact opposing interior surfaces of the end of the aperture and the edge of the stem of the post.

14. The extractor device of claim 12, wherein said shim has flanges on the faces opposite said first mentioned parallel surfaces to retain said insert in position when the device is in the gripping orientation.

15. The extractor device of claim 9, wherein the interior obtuse angle between the jacking portion and apertured portion of the plate is between 125° and 155°.

16. The extractor device of claim 9, wherein the interior obtuse angle between the jacking portion and apertured portion of the bent plate is substantially 135° so that when the plate is moved to its gripping orientation relative to a post, the jacking portion of the plate is substantially perpendicular to the length of the post and parallel to ground.

17. An extractor device for removing from the ground metal fence posts of the type having a substantially T-shaped cross-section and longitudinally spaced lugs, comprising:

a unitary metal plate having a post gripping portion and a jacking portion;

a generally T-shaped aperture formed in said post gripping portion substantially normal to the plane of the plate with the stem of the T aperture defining a generally longitudinal axis of the plate and terminating adjacent but spaced from one longitudinal extent of said plate, and with the cross of the T aperture disposed crosswise of the plate's longitudinal axis adjacent the jacking portion, said T-shaped aperture being sized so that in one orientation of the plate relative to the post, said T-shaped aperture fits over and slips along the length of the post, clearing post lugs, and in another orientation the plate's edges and margins around the T-shaped aperture engage the post and one lug adjacent the jacking portion of the plate to grip the post and to exert a jacking removal force thereon applied between ground and the jacking portion of the plate on the lug side of the post.

18. The extractor device of claim 17 in which said aperture has a beveled interior edge at the extent of the stem portion, said beveled interior edge of said aperture being aligned with the stem edge of the T-shaped post when the plate is in its gripping orientation relative to the post.

19. The extractor device of claim 17 further comprising a removable shim shaped and sized so as to fit in a space adjacent the stem portion of said aperture to contact and grip the stem portion of the T-shaped post when said plate is in its gripping orientation.

20. The extractor device of claim 17, wherein said T-shaped aperture is die stamped from said metal plate.

* * * * *